United States Patent [19]

Nilson

[11] Patent Number: 4,756,567

[45] Date of Patent: Jul. 12, 1988

[54] SELF-ADJUSTING BARREL HARNESS

[76] Inventor: Merwyn D. Nilson, P.O. Box 2762, Rapid City, S. Dak. 57709

[21] Appl. No.: 73,053

[22] Filed: Jul. 13, 1987

[51] Int. Cl.[4] ..... B66C 1/18

[52] U.S. Cl. ..... 294/74; 294/119.2

[58] Field of Search ..... 294/31.2, 67.41, 74, 294/82.14, 87.1, 87.2, 119.2, 149–151, 155, 164

[56] References Cited

U.S. PATENT DOCUMENTS

| | | | |
|---|---|---|---|
| 433,669 | 8/1890 | Austin | 294/74 |
| 933,093 | 9/1909 | Mitchell et al. | 294/74 |
| 1,222,166 | 4/1917 | Weaver | 294/74 |
| 1,551,886 | 9/1925 | Jensen | 294/74 |
| 1,573,878 | 2/1926 | Smith | 294/74 |
| 1,662,713 | 3/1928 | Miller | 294/74 |
| 2,443,307 | 6/1948 | De Cuir | 294/74 |
| 3,042,441 | 7/1962 | Jeffs et al. | 294/74 |
| 3,503,646 | 3/1970 | Solomon | 294/74 |
| 4,116,374 | 9/1978 | Garello | 294/31.2 X |
| 4,492,399 | 1/1985 | Randen et al. | 294/74 |

FOREIGN PATENT DOCUMENTS

| | | | |
|---|---|---|---|
| 886462 | 11/1971 | Canada | 294/74 |

*Primary Examiner*—Johnny D. Cherry

[57] ABSTRACT

The Bold Eagle Barrel Harness is a device readily, easily, and safely secured to, and removed from containers, for the purpose of lifting and transporting the containers, consisting of a combination of choker and two brackets assembled in such manner as to be totally adjustable in size and balance, and of a design that is constant and consistent with variable sizes, weights and materials of choker and bracket components, allowing usage unlimited by container size and weight.

1 Claim, 3 Drawing Sheets

SELF-ADJUSTING BARREL HARNESS

GENERAL DESCRIPTION AND PURPOSE

The Bold Eagle Barrel Harness is a device which is readily, easily, and safely secured to, and removed from, containers, such as, but not limited to, barrels and drums, so that such containers and contents may be lifted, transported, and lowered by equipment designed for such purpose. Containers are lifted vertically by the Bold Eagle Barrel Hardness and transported in that position. The Bold Eagle Barrel Harness may only be utilized on containers with one or more of the following characteristics; one end of said container must have a lip or protrusion completely around the outside perimeter adjacent to, or in the near proximity of, the end of the container; or two protrusions opposite each other across the diameter of the container and near one end of the container on the outside perimeter; or the container must be of a fibrous construction, or other material, allowing limited flexible compression beneath the Bold Eagle Barrel Harness; or the container must be of a flared design, increasing appreciably in diameter at the lift end.

BRIEF DESCRIPTION OF THE DRAWINGS

The various aspects of this invention will be more fully understood when the following specifications are read in conjunction with the accompanying drawings, with arrow lines designating components and unarrowed lines designating aspects of components, wherein.

DESCRIPTION OF THE PREFERRED EMBODIMENT

Figure 1:
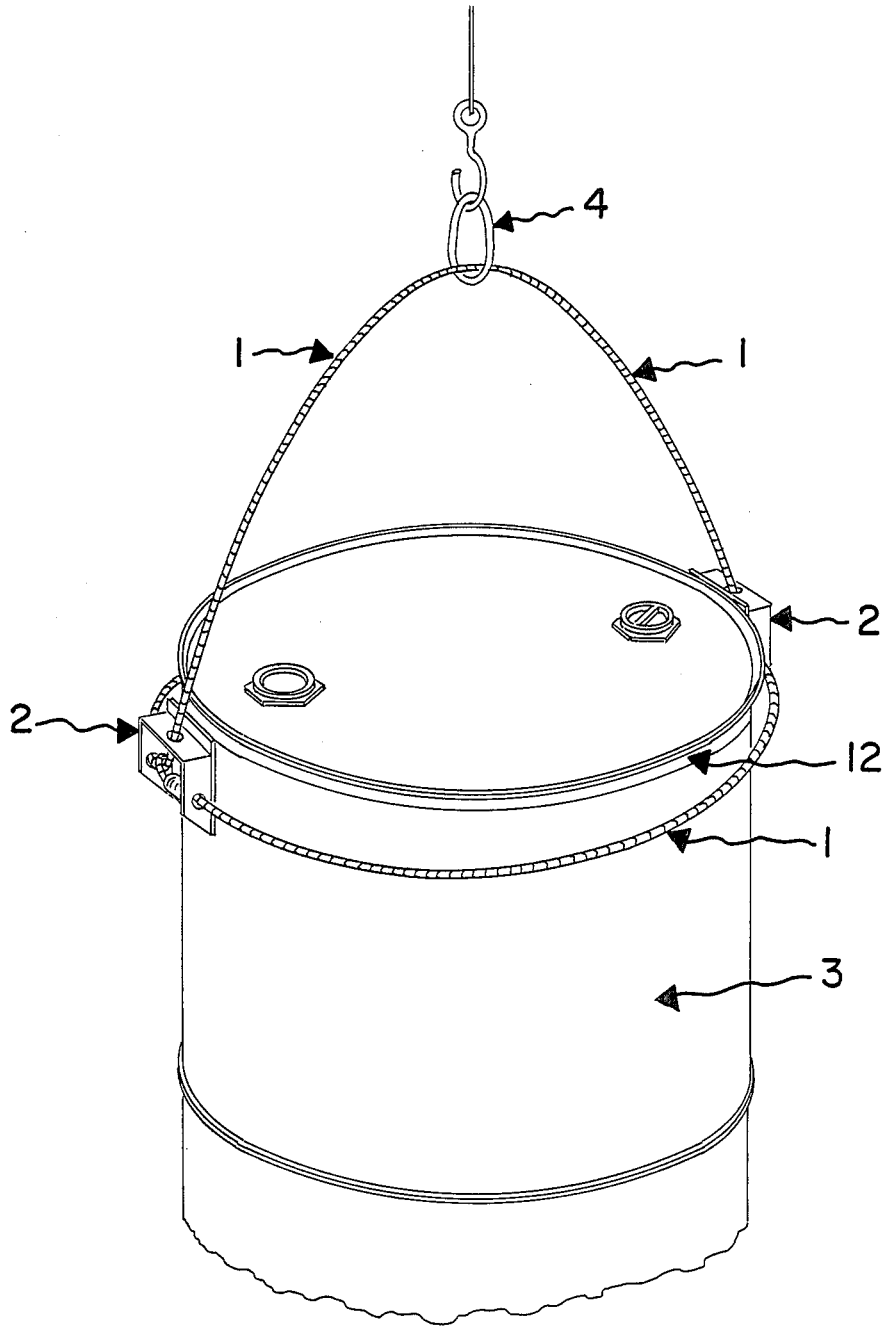
FIG. 1 is an illustration of the Bold Eagle Barrel Harness being positioned on a container.
Figure 2:
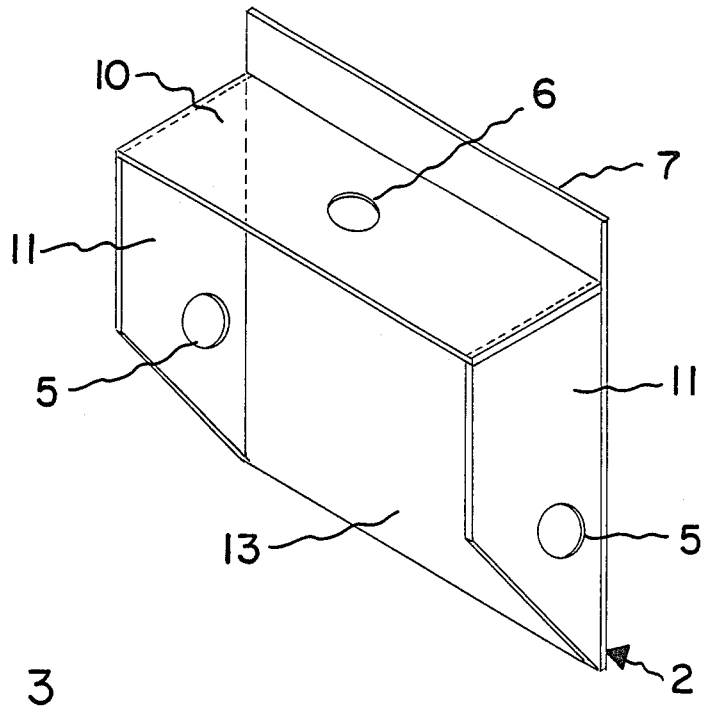
FIG. 2 is a perspective top view of a bracket.
Figure 3:
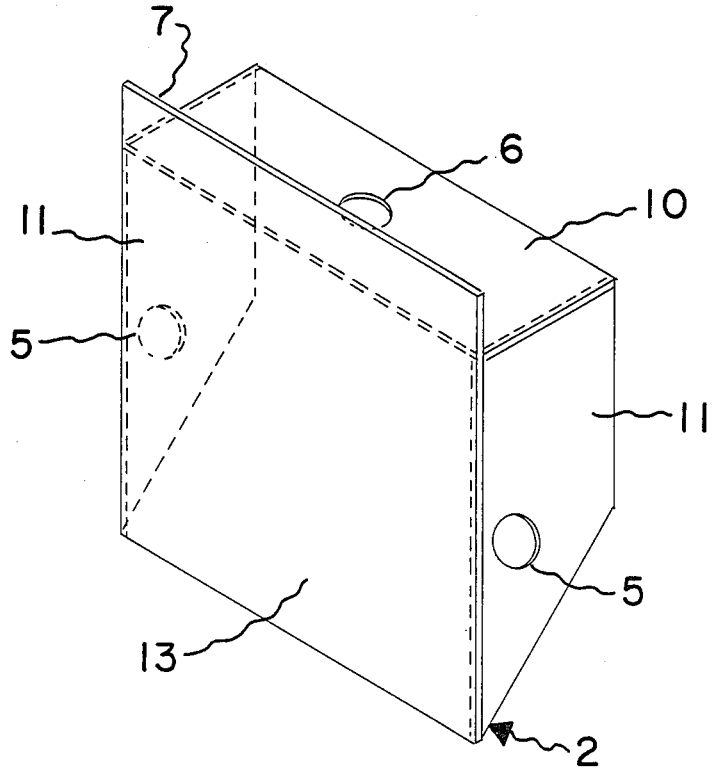
FIG. 3 is a perspective bottom view of a bracket.
Figure 4:
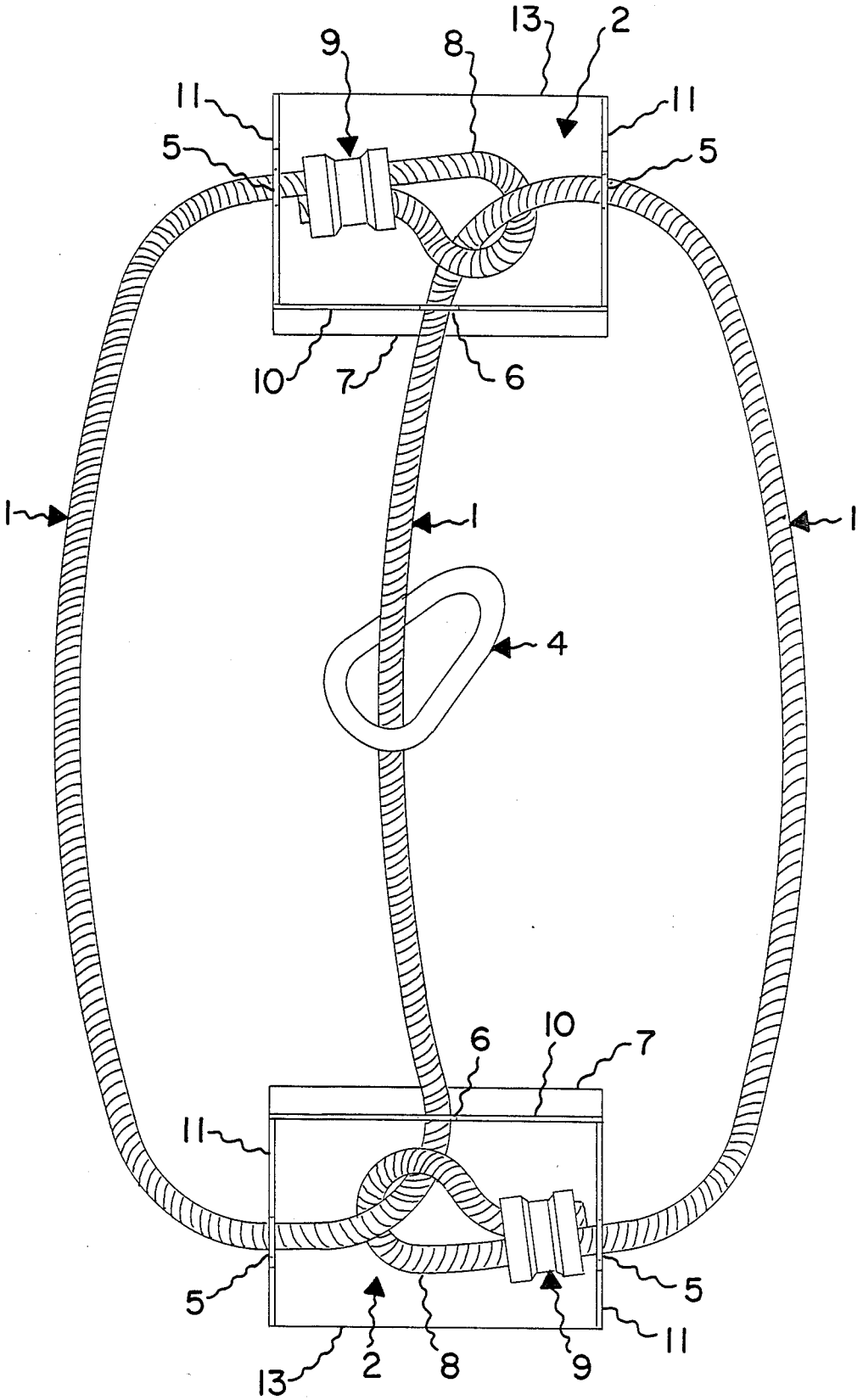
FIG. 4 is a view of an assembled Bold Eagle Barrel Harness including all components.

The Bold Eagle Barrel Harness acts as a "choker" (1) completely encompassing the perimeter near the top end of the container (3), in a manner that, by utilization of two specially designed brackets (2), a section on the choker (1) will cross the center of the end of the container (3) to provide a lifting point. The brackets (2) also provide initial gripping points preventing the choker (1) from slipping from the container (3) during initial lift, and when container (3) is subjected to severe jolting.

The choker (1) consists of a single length of cable, wire rope, fibrous rope, cord, or strap, of a length determined by the size of the container (3) to be lifted. Container (3) size, material, weight, and contacts determine the size, strength, and type of material of the choker (1).

The two specialized brackets (2) are identical, and are machined, cast, formed, or molded from metal, plastics, fiberglass, or other durable materials. The size and material of the brackets (2) is dependent upon the size, weight, configuration, and material of the container (3), and the size and material from which the choker (1) is made. The brackets (2) are of an essentially rectangular configuration. Each bracket (2) has a flat, or slightly concave, undersurface which lays against the side of the container (3) below the lip, protrusion, or flare (12), as previously described, and both sides of this surface are designated as the bottom (13) of the bracket (2). Flanges (10, 11), protrude outward, perpendicular to the bottom (13), on three sides. When the bracket (2) is positioned against an upright container (3), two of the flanges (11) are vertical, and parallel with the length of the container (3), and the third flange (10) is horizontal, parallel with, and adjacent to, the top end of the container (3). A small projection (7) the width of the bracket (2) extends from the bracket bottom (13), beneath, and perpendicular to, the third flange (10), and rests against the lip, protrusion, or flare (12) of the container (3). Each flange (10, 11) on the bracket (2) has a perforation or hole (5, 6) through it, large enough for the choker (1) to pass with ease. The hole (6) through the third flange (10) is approximately centered in that flange. The holes (5) through the other two flanges (11) are opposite each other and may vary in positioning, depending on size and weight of materials. All holes (5,6) vary in size and configuration, depending on size and material components of the choker (1).

Assembly of the components into the completed Bold Eagle Barrel Harness is accomplished in the following manner. One choker (1) end is formed into a small loop (8) and secured in that configuration by a clamp (9), or other suitable means, dependent upon choker (1) material. The other end of the choker (1) is inserted through the hole (5) in one of the bracket vertical flanges (11), from the center of bracket (2) outward, and is pulled through the hole (5) until only the loop (8) and clamp remain within the bracket (2). The unlooped end of the choker (1) is then inserted into the hole (5) in the opposite vertical flange (11) of the second bracket (2), from the outside into the center of the bracket (2). The choker (1) end then proceeds out of the second bracket (2) through the hole (6) in the horizontal third flange (10), of the second bracket (2). The choker (1) end may then pass through an optional lifting ring, or sling link (4). The choker (1) end is then inserted from the outside into the center of the first bracket (2) through the hole (6) in the horizontal third flange (10). The choker (1) end passes through the loop (8) formed in the opposite end of the choker (1), and then out of the bracket (2) through the hole (5) in the other vertical flange (11). The choker (1) passes back into the second bracket (2) through the hole (5) in the second vertical flange (11). A loop (8) is formed in the remaining end of the choker (1), encircling the section of the choker (1) that previously passed through the second bracket (2), and the loop (8) thus formed is secured with a clamp (9), or other appropriate means. The Bold Eagle Barrel Harness is a permanent assembly as described.

INSTALLATION ON CONTAINER

Installation of the Bold Eagle Barrel Harness on a container is accomplished as follows. The brackets are pulled away from each other, so that the three connecting strands of the choker are the same length. The harness is draped across the end of the container, with the brackets hanging over the opposite sides, and with the bottom of the brackets facing the container, and the third flanges on each bracket facing upward. The two outside strands of the choker are then slipped over the opposite sides of the container, positioned below the lip, protrusions, or flare, and completely encirle the container. The brackets now rest on opposite sides of the container, with the bracket bottoms in contact with the container. The horizontal third flanges are at the top of each bracket. The horizontal projections beneath the third flanges are below, and in contact with, the lip, protrusions, or flare of the container.

Tension on the portion of the choker extending across the top of the container, from bracket to bracket, tightens the choker. Increased tension induced by vertical lift will safely hoist the container and allow it to be transported. All connections and joints in the Bold Eagle Brarel Harness, with the exception of the choker end loop clamps, are designed to slip and automatically adjust to the perimeter size of the container. Therefore, each Bold Eagle Barrel Harness can be utilized on various sizes of containers.

I claim:

1. A self-adjusting lifting harness for handling cylindrical articles comprising:

a pair of bracket means for clampingly engaging substantially diametrically opposed points of an article to be lifted; and a single-length choker means adjustably connected to each of said bracket means and adapted to encircle the article for gripping thereof upon application of a lifting tension to a central portion of said choker means, said choker means including an end loop positioned within each of said bracket means, each said end loop encircling an intermediate portion of said choker means which extends through each of said bracket means;

whereby when said lifting tension is applied to said central portion, said choker means will tighten about the perimeter of the article and automatically adjust to the size thereof to evenly distribute gripping stress on the article.

* * * * *